US009935430B2

(12) United States Patent
Matsumura et al.

(10) Patent No.: US 9,935,430 B2
(45) Date of Patent: Apr. 3, 2018

(54) SPARK PLUG

(71) Applicant: NGK SPARK PLUG CO., LTD., Nagoya-shi, Aichi (JP)

(72) Inventors: Go Matsumura, Ama (JP); Kazuyoshi Torii, Nagoya (JP); Yasuhide Shimanokami, Nagoya (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 14/650,075

(22) PCT Filed: Dec. 13, 2013

(86) PCT No.: PCT/JP2013/083450
§ 371 (c)(1),
(2) Date: Jun. 5, 2015

(87) PCT Pub. No.: WO2014/097983
PCT Pub. Date: Jun. 26, 2014

(65) Prior Publication Data

US 2015/0372458 A1 Dec. 24, 2015

(30) Foreign Application Priority Data

Dec. 17, 2012 (JP) ..... 2012-275110

(51) Int. Cl.
*H01T 13/39* (2006.01)
*H01T 13/20* (2006.01)
*H01T 13/36* (2006.01)

(52) U.S. Cl.
CPC ..... *H01T 13/39* (2013.01); *H01T 13/20* (2013.01); *H01T 13/36* (2013.01)

(58) Field of Classification Search
CPC ..... H01T 13/39; H01T 13/36; H01T 13/20
See application file for complete search history.

(56) References Cited

U.S. PATENT DOCUMENTS

| | | | | |
|---|---|---|---|---|
| 6,337,533 | B1 | 1/2002 | Hanashi et al. | 313/141 |
| 2002/0003389 | A1 | 1/2002 | Ishiguro | 313/141 |
| 2003/0038577 | A1 | 2/2003 | Hori et al. | 313/141 |
| 2010/0253203 | A1 * | 10/2010 | Suzuki | H01T 13/39 313/141 |

FOREIGN PATENT DOCUMENTS

| | | | | |
|---|---|---|---|---|
| DE | 10134671 | A1 | 2/2003 | H01T 13/20 |
| JP | 2000-040577 | A | 2/2000 | H01T 13/20 |
| JP | 2002-093547 | A | 3/2002 | H01T 13/16 |
| JP | 2003-068421 | A | 3/2003 | H01T 13/20 |
| JP | 2004-538617 | A | 12/2004 | H01T 13/20 |
| JP | 2005-150011 | A | 6/2005 | H01T 13/20 |
| JP | 2007-242456 | A | 9/2007 | H01T 13/20 |
| JP | 2007242456 | A * | 9/2007 | |

OTHER PUBLICATIONS

Search report issued in corresponding International Patent Application No. PCT/JP2013/083450, dated Mar. 4, 2014.

* cited by examiner

*Primary Examiner* — Kevin Quarterman
(74) *Attorney, Agent, or Firm* — Kusner & Jaffe

(57) ABSTRACT

A spark plug having a of center electrode, a ground electrode, and a noble metal tip that is laser-welded to at least one of the center electrode and the ground electrode The noble metal tip is joined to the electrode through a fused portion formed by laser welding, and the fused portion includes a first fused portion and a second fused portion.

13 Claims, 4 Drawing Sheets

SPARK PLUG

RELATED APPLICATIONS

This application is a National Stage of International Application No. PCT/JP2013/083450 filed Dec. 13, 2013, which claims the benefit of Japanese Patent Application No. 2012-275110 filed Dec. 17, 2012.

FIELD OF THE INVENTION

The present invention relates to a spark plug and particularly to a spark plug having a noble metal portion provided in at least one of a ground electrode and a center electrode.

BACKGROUND OF THE INVENTION

A spark plug used for ignition of an internal combustion engine, such as an automobile engine, generally includes: a tubular metallic shell; a tubular insulator disposed in a bore of the metallic shell; a center electrode disposed in a bore of the insulator at the forward end of the bore; and a ground electrode with one end joined to the forward end of the metallic shell and the other end forming a spark discharge gap between the other end and the center electrode. With the spark plug, spark discharge occurs in the spark discharge gap formed between the distal end of the center electrode and the forward end of the ground electrode within a combustion chamber of an internal combustion engine to thereby ignite fuel injected into the combustion chamber.

For the purpose of improving the durability of spark plugs, noble metal tips formed from a noble metal alloy have conventionally been provided on the discharge surface of the ground electrode and the discharge surface of the center electrode that face each other. However, increasing the degree of compression within combustion chambers and lean burn have recently become mainstream practices, and the use environment of spark plugs has become increasingly severe. Therefore, there is demand for further development of spark plugs that can maintain durability even in such a severe environment.

Even when a tip formed of high-melting point Ir alloy is used as the material of a spark discharge electrode, the resistance of the tip to spark wear is insufficient. To address this problem, Japanese Patent Application Laid-Open (kokai) No. 2002-93547, for example, has as its object to improve the heat dissipation of an Ir alloy tip (see paragraphs 0003 to 5 in Japanese Patent Application Laid-Open (kokai) No. 2002-93547). The solution to the problem described in Japanese Patent Application Laid-Open (kokai) No. 2002-93547 is "the spark plug being characterized in that the Ir alloy tip is embedded in an end portion of the ground electrode with part of the Ir alloy tip exposing from the discharge surface and that, when the discharge surface is viewed from the top, a side edge (47) of the Ir alloy tip coincides with an outer circumferential edge of the discharge surface or is located inward of the outer circumferential edge of the discharge surface" (see claim 1 of Japanese Patent Application Laid-Open (kokai) No. 2002-93547).

One possible method of ensuring sufficiently high wear resistance of a noble metal tip of a spark plug to extend its service life even in the recent severe use environment of the spark plug is to increase the diameter of the noble metal tip. However, when a noble metal tip with an increased diameter is laser-welded to an electrode in an ordinary manner, the noble metal tip may be easily separated from the electrode.

Therefore, when a noble metal tip with an increased diameter is used, the energy of the applied laser beam must be increased to ensure sufficiently high separation resistance of the noble metal tip. However, when the energy of the applied laser beam is increased, the exposed area of a fused portion between the noble metal tip and the electrode increases, and therefore the surface area of the noble metal tip decreases; i.e., the height of the noble metal tip from a discharge surface to the end of the fused portion decreases. In this case, a consumable portion of the noble metal tip decreases, so that the effect of extending the service life of the spark plug by increasing the diameter of the noble metal tip is reduced.

An advantage of the present invention is a spark plug in which a noble metal tip is provided on at least one electrode of a ground electrode and a center electrode (the at least one electrode may hereinafter be referred to simply as an electrode) and which is excellent in durability by virtue of the noble metal tip having a sufficiently high wear resistance and a sufficiently high separation resistance.

SUMMARY OF THE INVENTION (1) In accordance with a first aspect of the present invention, there is provided a spark plug comprising a center electrode, a ground electrode, and a noble metal tip laser-welded to at least one electrode of the center electrode and the ground electrode (the at least one electrode being hereinafter referred to as an electrode), the noble metal tip having a gap forming surface that forms a gap between the gap forming surface and the other electrode, wherein

- the noble metal tip is joined to the electrode through a fused portion formed by laser welding, and
- the fused portion includes a first fused portion and a second fused portion, the first fused portion being such that the fused portion is exposed at a second electrode surface opposite the gap forming surface and/or a first electrode surface to which the noble metal tip is joined, the second fused portion being such that the fused portion is exposed at a side circumferential surface of the noble metal tip.

(2) In accordance with a second aspect of the present invention, there is provided a spark plug as described in paragraph (1), wherein the noble metal tip and the electrode to which the noble metal tip is joined have respective facing surfaces facing each other.

(3) In accordance with a third aspect of the present invention, there is provided a spark plug as described in paragraph (2), wherein the ratio of the area of the fused portion in a second region to the area of a first region is at least 60%, the first region being a region that is surrounded by the side circumferential surface of the noble metal tip and located in a virtual plane extending in a radial direction of the noble metal tip and including a point of the second fused portion that is closest to the gap, the second region being a projection of the first region onto the first electrode surface.

(4) In accordance with a fourth aspect of the present invention, there is provided a spark plug as described in paragraph (3), wherein a surface of the noble metal tip that is opposite the gap forming surface is joined entirely through the fused portion to the electrode to which the noble metal tip is joined.

(5) In accordance with a fifth aspect of the present invention, there is provided a spark plug as described in any of paragraphs (1) through (4), wherein the noble metal tip is placed on and joined to a flat surface of the electrode to which the noble metal tip is joined, or the noble metal tip is partially embedded in and joined to a recess formed on a surface of the electrode and the axial length of a portion of the noble metal tip embedded in the recess is 0.15 mm or less.

In the spark plug of the present invention, the noble metal tip is joined to the electrode through the fused portion formed by laser welding. The fused portion includes the first fused portion and the second fused portion. In the first fused portion, the fused portion is exposed at a second electrode surface opposite the gap forming surface and/or a first electrode surface to which the noble metal tip is joined. In the second fused portion, the fused portion is exposed at the side circumferential surface of the noble metal tip. Since the exposed area of the second fused portion that has lower wear resistance than the noble metal tip is reduced as much as possible, the wear resistance is improved. Since the first fused portion is provided, separation resistance is ensured.

When the spark plug is used in a severe environment, it is contemplated that, for example, the diameter of the noble metal tip is increased in order to ensure sufficiently high wear resistance of the noble metal tip. Even in such a case, the first fused portion provided prevents easy separation of the noble metal tip, so that sufficiently high separation resistance can be ensured without increasing the exposed area of the second fused portion. Even when the diameter of the noble metal tip is increased, it is not necessary to increase the exposed area of the second fused portion accordingly in order to ensure the separation resistance, thereby ensuring the surface area of the noble metal tip; i.e., the distance from the gap forming surface to a point in the second fused portion that is closest to the gap. Since the noble metal tip is worn from the gap forming surface; i.e., the discharge surface, in a depth direction, the longer (i.e., the greater) the above distance, the longer the service life of the noble metal tip. Therefore, according to the spark plug of the present invention, the separation resistance of the noble metal tip can be ensured, and the wear resistance can also be improved to an extent equivalent to an increase in the volume of the noble metal tip achieved by increasing its diameter.

In the spark plug of the present invention, the noble metal tip and the electrode to which the noble metal tip is joined may have respective facing surfaces that face each other. In this case, the noble metal tip and the electrode joined by laser welding have non-fused portions that are in direct contact with each other. The thermal conductivity of the electrode is higher than the thermal conductivity of the fused portion formed by fusing the noble metal tip and the electrode. Therefore, when the noble metal tip and the electrode have respective facing surfaces that face each other with no fused portion therebetween, heat generated by spark discharge and heat received by the noble metal tip from a high-temperature combustion chamber can be easily dissipated through the facing surfaces (the heat dissipation may hereinafter be referred to as heat transfer). Therefore, the spark plug having the facing surfaces has much higher wear resistance.

In the spark plug of the present invention, the ratio of the area of the fused portion in the second region to the area of the first region may be at least 60%. Specifically, since the noble metal tip and the electrode are joined to each other through the fused portion at the above area ratio, the separation resistance of the noble metal tip can be sufficiently ensured.

In the spark plug of the present invention, the surface of the noble metal tip that is opposite the gap forming surface may be joined entirely through the fused portion to the electrode to which the noble metal tip is joined. Specifically, the noble metal tip and the electrode do not have facing surfaces which are in direct contact with each other, and the entire noble metal tip is in contact with the electrode through the fused portion. Therefore, the occurrence of separation of the noble metal tip starting from the facing surfaces can prevented, and the separation resistance of the noble metal tip can be further improved.

In the spark plug of the present invention, the noble metal tip may be placed on and joined to a flat surface of the electrode. Alternatively, the noble metal tip may be partially embedded in and joined to a recess formed on a surface of the electrode, and the axial length of the portion of the noble metal tip that is embedded in the recess may be 0.15 mm or less. The portion of the noble metal tip that is embedded in the recess of the electrode does not contribute to the improvement in the wear resistance. When the noble metal tip is placed on and joined to the flat surface of the electrode, the noble metal tip does not have such an embedded portion. Therefore, a wear resistance improving effect corresponding to the volume of the joined noble metal tip is obtained. In the spark plug of the present invention in which the noble metal tip is joined to the electrode through the first fused portion and the second fused portion, it is more effective for improvement of the wear resistance that the noble metal tip is joined to the electrode without being embedded in the electrode. When the noble metal tip is partially embedded in and joined to the recess of the electrode, the second fused portion can be formed by laser welding such that almost no second fused portion is exposed at the side circumferential surface. Thus, the surface area of the noble metal tip can be maximized. Therefore, deterioration of the effect of improving the wear resistance by the noble metal tip, which deterioration is caused by the second fused portion, can be suppressed. When the noble metal tip is partially embedded in and joined to the recess of the electrode, the separation resistance is enhanced as compared with the case where the noble metal tip is placed on and joined to the flat surface of the electrode. As the axial length of the portion of the noble metal tip that is embedded in the recess increases, the volume of the embedded portion that does not contribute to the improvement in the wear resistance increases, and therefore the wear resistance improving effect corresponding to the volume of the noble metal tip cannot be obtained. When the portion of the noble metal tip, the portion being embedded in the recess, is 0.15 mm or less, the effect of improving the wear resistance by the noble metal tip is obtained while the separation resistance between the noble metal tip and the electrode is improved.

BRIEF DESCRIPTION OF THE DRAWINGS

FIG. 2(*a*) is a cross-sectional view illustrating an essential part of the spark plug shown in FIG. 1, showing a section taken along a plane including the center axis of the noble metal tip.

FIG. 2(*b*) is a partially sectional view illustrating the essential part, showing a section taken along a plane including a first electrode surface of a ground electrode.

DETAILED DESCRIPTION OF THE PREFERRED EMBODIMENT

The spark plug according to the present invention includes a center electrode, a ground electrode, and a noble metal tip laser-welded to at least one of the center electrode and the ground electrode. No structural limitation is imposed on the spark plug according to the present invention so long as the spark plug has the above-described structure, and any of various known structures may be used.

Figure 1:
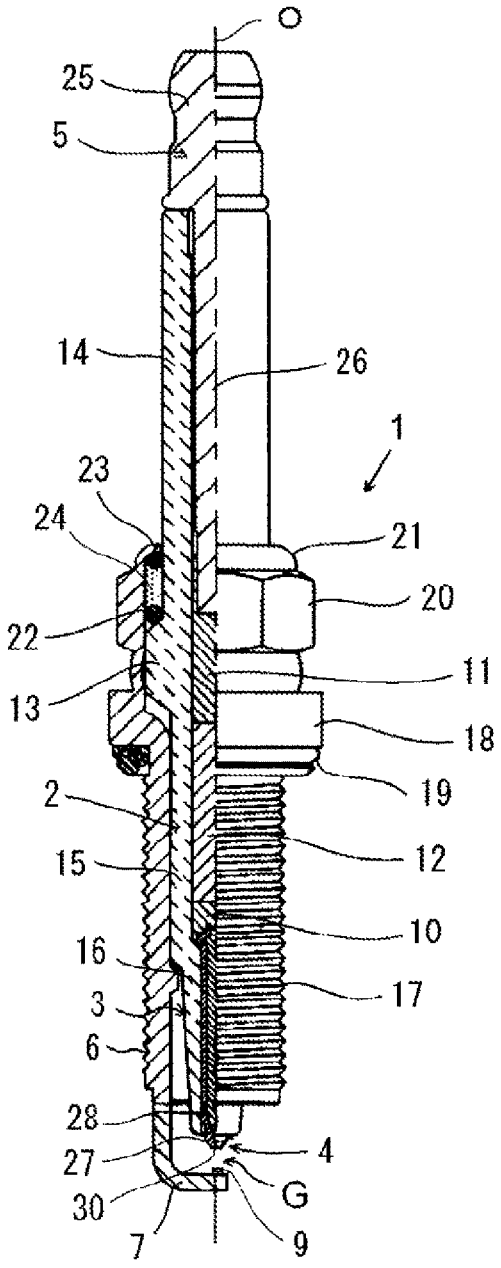
FIG. 1 is a partially sectional general view illustrating a spark plug which is an embodiment of the spark plug according to the present invention.
Figure 2A:
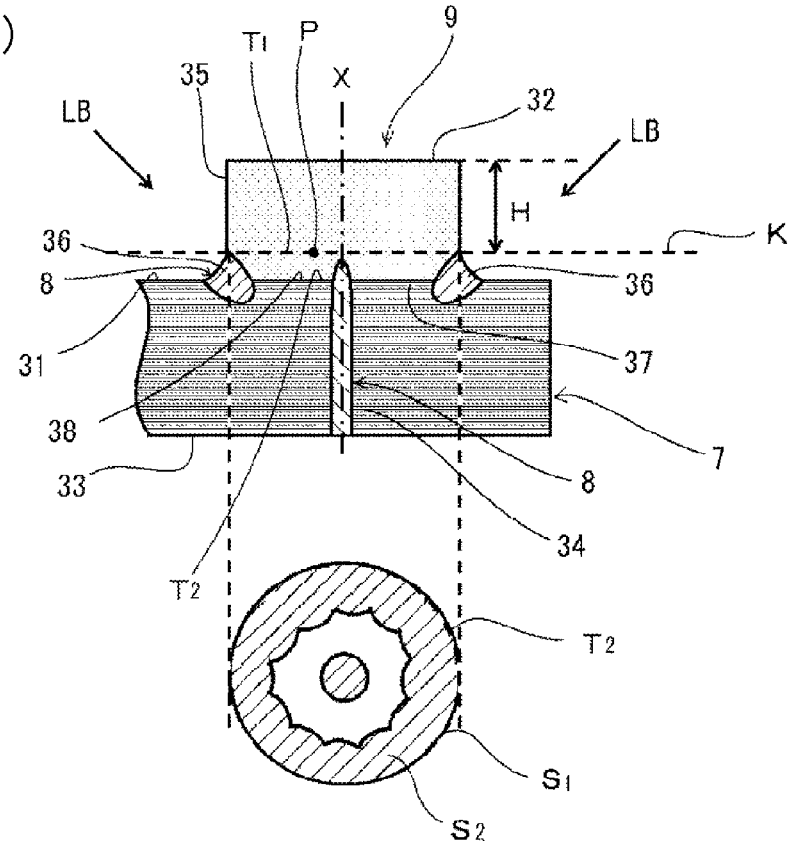
FIG. 2(*a*) and FIG. 2(*b*) are cross-sectional views illustrating an essential part of the spark plug shown in FIG. 1, showing a joint portion of a noble metal tip of the spark plug.
Figure 2B:
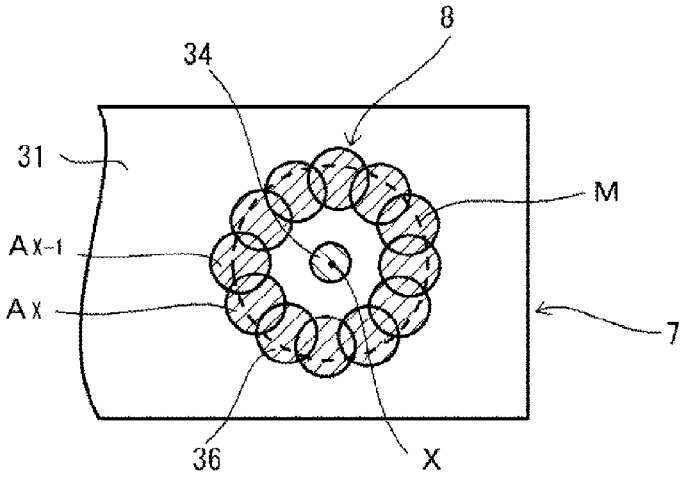

A spark plug which is an embodiment of the spark plug according to the present invention is shown in FIGS. 1, 2(*a*) and 2(*b*). FIG. 1 is a partially sectional general view illustrating the spark plug 1 which is one embodiment of the spark plug according to the present invention. FIGS. 2(*a*) and 2(*b*) are a set of cross-sectional views illustrating an essential part of the spark plug shown in FIG. 1, showing a joint portion of the noble metal tip of the spark plug. In the following description, a direction toward the lower side of the sheet of FIG. 1 or 2(*a*) is referred to as a forward direction along an axis O, and a direction toward the upper side of the sheet is referred to as a rearward direction along the axis O.

As shown in FIGS. 1, 2(*a*) and 2(*b*), the spark plug 1 includes a substantially cylindrical insulator 3 having an axial bore 2 extending in the direction of the axis O. A substantially rod-shaped center electrode 4 is disposed within the axial bore 2 at its forward end, a metal terminal 5 disposed within the axial bore 2 at its rearward end. A substantially cylindrical metallic shell 6 holds the insulator 3. A ground electrode 7 has one end of which is joined to the forward end of the metallic shell 6 and the other end of which faces a forward end surface 30 of the center electrode 4. The ground electrode 7 has a noble metal tip 9 joined thereto through a fused portion 8 formed by laser welding. The noble metal tip 9 is disposed with a gap G formed between the noble metal tip 9 and the forward end surface 30 of the center electrode 4.

The insulator 3 has the axial bore 2 extending in the direction of the axis O. The center electrode 4 is disposed within the axial bore 2 at its forward end, and the metal terminal 5 is disposed within the axial bore 2 at its rearward end. Seal bodies 10 and 11 for fixing the center electrode 4 and the metal terminal 5 within the axial bore 2 and a resistor 12 for reducing radio noise are disposed between the center electrode 4 and the metal terminal 5. A flange portion 13 protruding radially is formed near the center, with respect to the direction of the axis O, of the insulator 3. A rear trunk portion 14 that accommodates the metal terminal 5 and insulates the metal terminal 5 from the metallic shell 6 is formed rearward of the flange portion 13. A forward trunk portion 15 that accommodates the resistor 12 is formed forward of the flange portion 13, and a leg portion 16 that accommodates the center electrode 4 and has an outer diameter smaller than the outer diameter of the forward trunk portion 15 is formed forward of the forward trunk portion 15. The insulator 3 is fixed to the metallic shell 6 with the forward end of the insulator 3 protruding from the forward end surface of the metallic shell 6. Preferably, the insulator 3 is formed from a material having mechanical strength, thermal strength, and electric strength. Examples of such a material include a ceramic sintered body formed mainly of alumina.

The metallic shell 6 has a cylindrical shape and is formed so as to hold the insulator 3 inserted thereinto. A threaded portion 17 is formed on the outer circumferential surface of a forward end portion of the metallic shell 6. The spark plug 1 is attached to the cylinder head of an internal combustion engine (not shown) through the threaded portion 17. A flange-shaped gas seal portion 18 is formed rearward of the threaded portion 17, and a gasket 19 is fitted between the gas seal portion 18 and the threaded portion 17. A tool engagement portion 20 for engagement with a tool such as a spanner or a wrench is formed rearward of the gas seal portion 18, and a crimp portion 21 is formed rearward of the tool engagement portion 20. Ring-shaped packings 22 and 23 and talc 24 are disposed in an annular space formed between the outer circumferential surface of the insulator 3 and the inner circumferential surfaces of the crimp portion 21 and the tool engagement portion 20, and the insulator 3 is thereby fixed to the metallic shell 6. The metallic shell 6 may be formed from a steel material having electrical conductivity such as low-carbon steel.

The metal terminal 5 is used to externally apply to the center electrode 4 a voltage for generating spark discharge between the center electrode 4 and the ground electrode 7. The metal terminal 5 includes an exposed portion 25 and a substantially cylindrical columnar portion 26. The exposed portion 25 has an outer diameter larger than the inner diameter of the axial bore 2 and protrudes from the axial bore 2 with a flange-shaped portion of the exposed portion 25 partially in contact with a rear end surface, with respect to the direction of the axis O, of the insulator 3. The columnar portion 26 extends forward from the forward end surface, with respect to the direction of the axis O, of the exposed portion 25 and is accommodated in the axial bore 2. The metal terminal 5 may be formed from a metal material such as low-carbon steel.

The center electrode 4 has a substantially rod shape and is composed of an outer layer 27 and a core 28 that is formed so as to be embedded coaxially at the center of the outer layer 27. The center electrode 4 is fixed within the axial bore 2 of the insulator 3 with the forward end of the center electrode 4 protruding from the forward end of the insulator 3 and is insulated from the metallic shell 6. The core 28 is formed from a material having a thermal conductivity higher than that of the outer layer 27, and examples of such a material include Cu, Cu alloys, Ag, Ag alloys, and pure Ni. The outer layer 27 may be formed from any well-known material used for center electrodes, and it is preferable to use a Ni alloy such as Inconel 600 to form the outer layer 27.

The ground electrode 7 is formed to have, for example, a substantially prism shape. The ground electrode 7 is joined at one end to the forward end of the metallic shell 6 and bent at an intermediate portion into a substantially L-shape, and the other end of the ground electrode 7 is disposed with a gap between the other end and the center electrode 4. As shown in FIGS. 2(*a*) and 2(*b*), the ground electrode 7 has a first electrode surface 31 that faces the forward end surface 30 of the center electrode 4. Cylindrical noble metal tip 9 is joined to the first electrode surface 31 by laser welding. The ground electrode 7 may be formed from any well-known material used for ground electrodes, and it is preferable to use a Ni alloy such as Inconel 600 to form the ground electrode 7. The ground electrode 7 in the present embodiment is a rod-shaped electrode having a rectangular cross section, taken perpendicular to the lengthwise direction of the electrode. However, no particular limitation is imposed on the shape of the ground electrode 7 so long as the ground electrode 7 can be disposed with a prescribed gap between the ground electrode 7 and the center electrode 4. The ground electrode 7 may be a rod-shaped electrode whose cross section has an elliptic shape, an oval shape such as a rounded rectangular, which is formed with opposite straight lines and opposite curve lines, an egg-like shape, a polygonal shape such as a triangular or pentagonal shape, a circular shape, a semicircular shape, a rectangular shape with two corners rounded or a shape with one straight line and a rounded curvature, a trapezoidal shape, etc.

The noble metal tip 9 is placed on the first electrode surface 31 and disposed such that the gap G is formed between the forward end surface 30 of the center electrode 4 and a gap forming surface 32 that faces the forward end surface 30. The gap G in the spark plug 1 in the present embodiment is the shortest distance between the forward end surface 30 and the gap forming surface 32, and the gap G is generally set to 0.3 to 1.5 mm. In the spark plug 1 in the present embodiment, the noble metal tip 9 is provided only on the ground electrode 7 that tends to have a higher temperature, and no noble metal tip is provided on the center electrode 4. It is only necessary that a noble metal tip be provided on at least one of the center electrode and the ground electrode. For example, a noble metal tip may be provided on each of the ground electrode and the center electrode. In this case, the shortest distance between the noble metal tip disposed on the ground electrode and the noble metal tip disposed on the center electrode is the gap, and spark discharge occurs in the gap.

The noble metal tip 9 is formed from a noble metal alloy, and examples of the noble metal alloy include a noble metal alloy containing Pt or Jr as a main component and at least one none-base noble metal selected from Pd, Rh, Ru, W, Os, Ni, Pt, Jr, etc. The noble metal tip 9 has a cylindrical shape, but no particular limitation is imposed on the shape of the noble metal tip 9. Any appropriate shape such as a disk shape, a polygonal plate shape, a polygonal prism shape, a polygonal pyramid shape, a truncated conical shape, a truncated polygonal pyramid shape, or a combination thereof may be used. Examples of the shape of a combination of a plurality of noble metal tips with different shapes include a shape in which a small disk is stacked on a large disk and a shape in which a quadrangular pyramid is stacked on a quadrilateral plate. The noble metal tip 9 is joined to the first electrode surface 31 through the fused portion 8 formed by laser welding. When the noble metal tip 9 is disposed on at least one of the discharge surfaces located between the center electrode 4 and the ground electrode 7; i.e., on the forward end surface 30 and/or the first electrode surface 31, the durability of the spark plug can be improved because the noble metal tip 9 formed from a noble metal alloy has a higher melting point than the center electrode 4 and the ground electrode 7 formed from, for example, a Ni alloy and is therefore less likely to be worn.

The fused portion 8 includes a first fused portion 34 and a second fused portion 36. In the first fused portion 34, the fused portion 8 is exposed at a second electrode surface 33 opposite the first electrode surface 31 on which the noble metal tip 9 is joined. In the second fused portion 36, the fused portion 8 is exposed at a side circumferential surface 35 of the noble metal tip 9. The noble metal tip 9 is joined through the first fused portion 34 and the second fused portion 36 and therefore has a sufficiently high wear resistance and a sufficiently high separation resistance. In other words, in the spark plug 1, the noble metal tip 9 is joined to the ground electrode 7 through the first fused portion 34 and the second fused portion 36. Therefore, the wear resistance can be improved by reducing as much as possible the exposed area of the second fused portion 36 having lower wear resistance than the noble metal tip 9, and the first fused portion 34 ensures sufficiently high separation resistance. When the exposed area of the second fused portion 36 can be reduced as much as possible, the surface area of the noble metal tip 9; i.e., the distance H, in the direction of a center axis X, from the gap forming surface 32 to a point of the second fused portion 36 that is closest to the gap G, can be maximized. Since the noble metal tip is worn from the gap forming surface 32 in a depth direction, the longer the distance H, the longer the service life of the noble metal tip. As described above, the wear resistance can be improved by reducing the exposed area of the second fused portion 36 as much as possible, and the first fused portion 34 provided in addition to the second fused portion 36 ensures sufficiently high separation resistance.

When the spark plug is used in a severe environment, it is contemplated that, for example, a noble metal tip with an increased diameter is used in order to ensure sufficiently high wear resistance of the noble metal tip. Even in such a case, the first fused portion 34 prevents the noble metal tip 9 from being easily separated, so that sufficiently high separation resistance can be ensured without increasing the exposed area of the second fused portion 36. Even when the diameter of the noble metal tip 9 is increased, it is not necessary to increase the exposed area of the second fused portion 36 in order to ensure sufficiently high separation resistance, so that the surface area of the noble metal tip 9; i.e., the distance H, can be ensured, as described above. Therefore, according to the spark plug of the present invention, while the separation resistance of the noble metal tip 9 is ensured, the wear resistance can be increased to an extent equivalent to an increase in the volume of the noble metal tip 9 achieved by increasing its diameter.

The first fused portion 34 can be formed by applying a laser beam from the second electrode surface 33 side toward the noble metal tip 9. The first fused portion 34 shown in FIG. 2 is formed so as to extend from the second electrode surface 33 toward the noble metal tip 9, pass through the ground electrode 7, and bite, i.e., penetrate, into the noble metal tip 9. The first fused portion 34 is not particularly limited to the above form. The first fused portion 34 may be formed so as to extend from the second electrode surface 33 through the ground electrode 7 and the noble metal tip 9 and reaches the gap forming surface 32. Alternatively, the first fused portion 34 may be formed by applying a laser beam directly to the noble metal tip 9. In this case, the first fused portion 34 is formed so as to pass from the gap forming surface 32 through the noble metal tip 9 and bite, i.e., penetrate, into the ground electrode 7 with the fused portion 8 appearing on the gap forming surface 32.

In FIGS. 2(*a*) and 2(*b*), only one first fused portion 34 extending on the center axis X of the noble metal tip 9 is provided. However, no particular limitation is imposed on the number of first fused portions 34. For example, 1 to 5 first fused portions may be provided, although it depends on their diameter etc. These first fused portions may be formed parallel to each other so as not to come into contact with each other or may be formed so as to be parallel to or intersect with each other such that part of them are in contact with each other or intersect with each other. The size of the first fused portion 34 can be controlled by adjusting the energy level of the applied laser beam, its spot diameter, irradiation time, etc. When a plurality of first fused portions are provided, they may have substantially the same size or different sizes.

In a region of the first fused portion 34 in the vicinity of the boundary between the noble metal tip 9 and the ground electrode 7, the materials forming the noble metal tip 9 and the materials forming the ground electrode 7 are dissolved into each other, and therefore this region contains these materials. As the distance from the noble metal tip 9 toward the second electrode surface 33 increases, the content of the materials forming the ground electrode 7 increases. A region of the first fused portion 34 in the vicinity of the second electrode surface 33 is formed mostly from the materials forming the ground electrode 7. For example, when the first fused portion is formed so as to appear on the gap forming surface, a region of the first fused portion 34 in the vicinity of the gap forming surface is formed mostly from the materials forming the noble metal tip. Therefore, the region of the first fused portion that is exposed at the gap forming surface has a high wear resistance comparable to the wear resistance of the noble metal tip.

The second fused portion 36 is composed of a plurality of fused portions $A_n$ (n is an integer of 1 or more) that are formed by applying a laser beam, in a direction oblique to the first electrode surface 31, to a region in the vicinity of a line of intersection M of the side circumferential surface 35 of the noble metal tip 9 and the first electrode surface 31, which line is present before the noble metal tip 9 is laser-welded to the ground electrode 7. As shown in FIG. 2(*a*), in a cross-section including the center axis X of the noble metal tip 9, each of the fused portions $A_n$ has a substantially semielliptical shape with its major axis extending in the direction LB of application of the laser beam. As shown in FIG. 2(*b*), in a cross section obtained by cutting the noble metal tip 9 along a plane including the first electrode surface 31, each of the fused portions $A_n$ has a substantially circular shape. The size of the fused portions $A_n$ varies depending on the energy level of the applied laser beam, irradiation time, etc. The fused portions $A_n$ may have the same size or different sizes.

Figure 3:
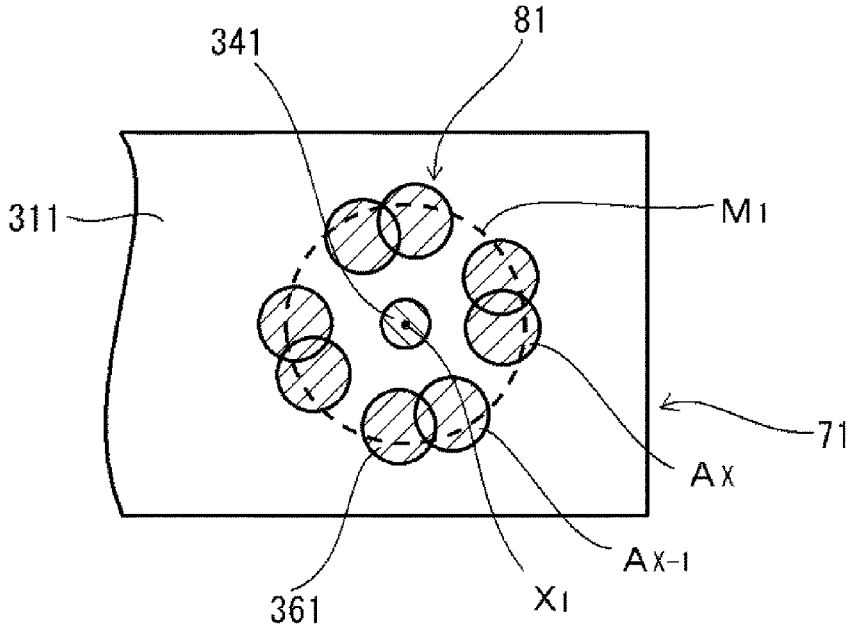
FIG. 3 is a partially sectional view illustrating an essential part of a spark plug which is another embodiment of the spark plug according to the present invention, showing a section taken along a plane including the first electrode surface.

In the noble metal tip 9 shown in FIG. 2(*b*), the second fused portion 36 is formed over the entire line of intersection M such that adjacent fused portions $A_{x-1}$ and $A_x$ (x is an integer from 1 to n) overlap each other. However, as shown in FIG. 3, a plurality of fused portions $A_{n1}$ may be formed on the line of intersection $M_1$ such that, for example, some adjacent fused portions $A_{x1-1}$ and $A_{x1}$ or all the fused portions $A_{n1}$ are disposed so as to be separated from each other at prescribed intervals. When a plurality of fused portions $A_{n1}$ are disposed, the intervals between adjacent pairs of fused portions $A_{x1-1}$ and $A_{x1}$ may be the same or different.

When a plurality of fused portions $A_n$ are disposed, it is preferable that the fused portions $A_n$ are disposed so as to be point-symmetric with respect to the center axis when the noble metal tip is viewed from the above. For example, it is preferable that, in a cross section including the center axis X of the noble metal tip 9, at least fused portions $A_n$ are formed on opposite sides of the center axis X serving as the center, as shown in FIG. 2(*a*).

Preferably, the second fused portion 36 is formed such that the ratio of the total length of the fused portions $A_n$ formed on the line of intersection M with respect to the overall length of the line of intersection M is at least 80%. More preferably, the second fused portion 36 is formed over the entire line of intersection M. When the second fused portion 36 is formed as described above, oxidation that occurs from the gap between the noble metal tip 9 and the ground electrode 7 can be suppressed, so that the occurrence of brittle fracture can be suppressed. In this manner, the separation resistance can be further improved.

The second fused portion 36 contains the materials forming the noble metal tip 9 and the materials forming the ground electrode 7 because the materials forming the noble metal tip 9 and the materials forming the ground electrode 7 are dissolved into each other. Therefore, the wear resistance of the second fused portion 36 is lower than that of the noble metal tip 9. As described above, the second fused portion 36 is formed by irradiating the first electrode surface 31 obliquely with the laser beam. In this case, the surface area of the noble metal tip 9 having high wear resistance becomes small, and the exposed area of the second fused portion 36 increases accordingly. As the exposed area increases, the effect of improving the wear resistance obtained by joining the noble metal tip 9 decreases accordingly. As described above, the longer the distance H, the longer the service life of the noble metal tip. It is therefore preferable from the viewpoint of wear resistance that the exposed area is reduced as much as possible. When the exposed area of the second fused portion 36 is reduced in order to increase the effect of improving the wear resistance obtained by joining the noble metal tip 9, the noble metal tip 9 is easily separated. However, the noble metal tip 9 in the present invention is joined to the ground electrode 7 through the second fused portion 36 and the first fused portion 34. Therefore, although the exposed area of the second fused portion 36 is reduced as much as possible in order to improve the wear resistance, sufficiently high separation resistance can be ensured because not only the second fused portion 36 but also the first fused portion 34 is provided.

In the spark plug 1 in the present embodiment, the first fused portion 34 and the second fused portion 36 are separated from each other so as not to be in contact with each other. However, the first fused portion(s) 34 and the second fused portion 36 may be in contact with each other or overlap each other as a result of, for example, formation of a plurality of first fused portions 34 or a first fused portion 34 having a large volume, or formation a second fused portion 36 extending deep into the noble metal tip 9.

The noble metal tip 9 and the ground electrode 7 have a first facing surface 37 and a second facing surface 38, respectively, that face each other (hereinafter these surfaces may be collectively referred to as facing surfaces). Specifically, there is a region in which the noble metal tip 9 and the ground electrode 7 joined to each other by laser welding are in direct contact with each other with no fused portion 8 therebetween. The thermal conductivity of the ground electrode 7 formed from a Ni alloy is higher than the thermal conductivity of the fused portion 8 containing a noble metal alloy and the Ni alloy. Therefore, when the noble metal tip 9 and the ground electrode 7 have the facing surfaces 37 and 38 through which the noble metal tip 9 and the ground electrode 7 are in direct contact with each other with no fused portion 8 therebetween, heat generated by spark discharge and heat received by the noble metal tip 9 from a high-temperature combustion chamber are easily dissipated through the facing surfaces 37 and 38. Therefore, the spark plug including the first facing surface 37 and the second facing surface 38 has higher wear resistance. The spark plug including these facing surfaces 37 and 38 to improve heat transfer in the noble metal tip 9 is preferably used in an environment in which the noble metal tip is particularly required to have high wear resistance.

In a virtual plane K perpendicular to the center axis X of the noble metal tip 9 and including a point P of the second fused portion 36 that is closest to the gap G, let the area of a first region $T_1$ surrounded by the side circumferential surface 35 of the noble metal tip 9 be $S_1$, as shown in FIG. 2(*a*). Let the area of the fused portion 8 in a second region $T_2$ that is the projection of the first region $T_1$ onto the first electrode surface 31 be $S_2$. Then it is preferable that the ratio of the area $S_2$ to the area $S_1$ is at least 60%. When the noble metal tip 9 and the ground electrode 7 are joined to each other at the above area ratio through the fused portion 8, the separation resistance of the noble metal tip 9 can be sufficiently ensured.

It is particularly preferable that the noble metal tip 9 is configured as follows. As shown in FIG. 2(*b*), the second fused portion 36 is formed over the entire line of intersection M on which the side circumferential surface 35 and the first electrode surface 31 intersect with each other before the noble metal tip 9 is joined to the ground electrode 7. In addition, the second fused portion 36 and the first fused portion 34 are not in contact with each other and are separated from each other. The facing surfaces 37 and 38 are thereby present, and the area ratio described above is at least 60%. When the second fused portion 36 is formed over the entire line of intersection M, oxidation that occurs from the gap between the noble metal tip 9 and the ground electrode 7 can be suppressed, so that the occurrence of brittle fracture can be suppressed. In addition, since the heat received by the noble metal tip 9 can be easily transmitted to the ground electrode 7 through the facing surfaces 37 and 38, the separation resistance and wear resistance of the noble metal tip 9 can be further improved.

The area ratio $[(S_2/S_1)\times100]$ can be measured, for example, as follows. First, the noble metal tip 9 is cut along a plane including the point P and orthogonal to the center axis X, and then the area of the obtained cross section is measured, whereby the area $S_1$ can be determined. Then the noble metal tip 9 is cut along a plane including the first electrode surface 31. In the obtained cross section, a virtual circle having the area $S_1$ measured above is drawn with the origin at a point on the center axis of the noble metal tip 9, and the area of the fused portion 8 included in the second region $T_2$ surrounded by the circumference of the virtual circle is measured, whereby the area $S_2$ can be determined. The area $S_1$ and the area $S_2$ can also be measured by CT.

Figure 4:
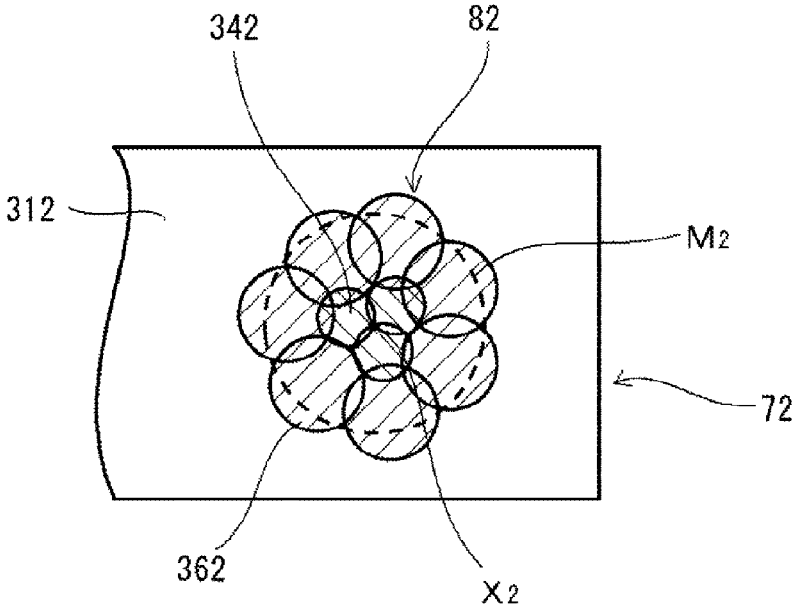
FIG. 4 is a partially sectional view illustrating an essential part of a spark plug which is still another embodiment of the spark plug according to the present invention, showing a section taken along a plane including the first electrode surface.

FIG. 4 is a partially sectional view illustrating an essential part of a spark plug which is another embodiment of the spark plug according to the present invention, showing a section of the noble metal chip taken along a plane including the first electrode surface of the ground electrode.

As shown in FIG. 4, in the noble metal tip in this spark plug, the entire surface of the noble metal tip that is opposite the gap forming surface is joined to the ground electrode 72 through a fused portion 82. In this case, the area ratio $[(S_2/S_1)\times100]$ is 100%. When the entire surface of the noble metal tip that is opposite the gap forming surface is joined to the ground electrode 72 through the fused portion 82, there are no facing surfaces through which the noble metal tip and the ground electrode 72 face each other. Therefore, separation of the noble metal tip that occurs from the facing surfaces can be prevented, so that the separation resistance of the noble metal tip can be further improved. The above spark plug is preferably used in an environment in which severe thermal cycles or strong vibrations cause the noble metal tip to be easily separated.

Figure 5:
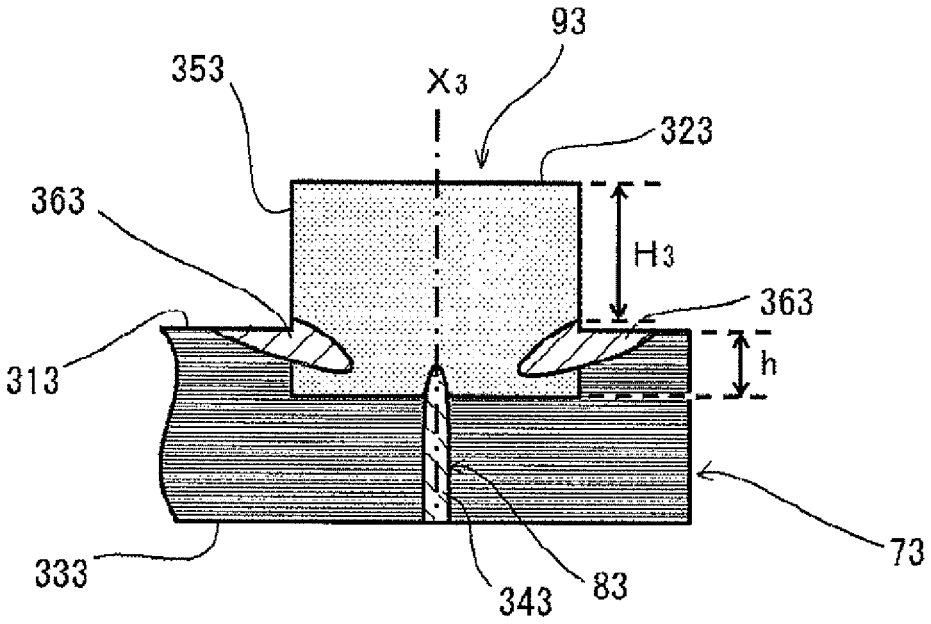
FIG. 5 is a cross-sectional view illustrating an essential part of a spark plug which is yet another embodiment of the spark plug according to the present invention, showing a section taken along a plane including the center axis of the noble metal tip.

FIG. 5 is a cross-sectional view illustrating an essential part of a spark plug which is yet another embodiment of the spark plug according to the present invention, showing a section taken along a plane including the center axis of the noble metal tip.

The noble metal tip 9 shown in FIG. 2 is placed on and joined to a flat surface of the substantially prism-shaped ground electrode 7. However, as shown in FIG. 5, the noble metal tip 93 may be partially embedded in a recess formed on the first electrode surface 313 of the ground electrode 73 and joined to the recess by laser welding. When the noble metal tip 93 is partially embedded in the ground electrode 73, it is preferable that the length h of the embedded portion of the noble metal tip 93 in the direction of axis $X_3$ is 0.15 mm or less. When the noble metal tip 93 is partially embedded in the ground electrode 73, the second fused portion 363 can be formed by laser welding such that almost no second fused portion 363 appears on the side circumferential surface 353 of the noble metal tip 93 as shown in FIG. 5, so that the surface area of the noble metal tip 93; i.e., distance $H_3$, can be maximized. Therefore, when the noble metal tip 93 is partially embedded in and joined to the ground electrode 73, deterioration of the effect of improving the wear resistance by the noble metal tip 93, which deterioration is caused by the second fused portion 363, can be suppressed. When the noble metal tip 93 is partially embedded in and joined to the ground electrode 73, the improvement in the separation resistance is higher than that when the noble metal tip 93 is not embedded in the ground electrode 73. In the noble metal tip joined in the manner shown in FIG. 5, the portion of the noble metal tip 93 that is embedded in the ground electrode 73 does not much contribute to the improvement in wear resistance. Therefore, the greater the length h of the portion of the noble metal tip 93 embedded in the ground electrode 73, the smaller the wear resistance improving effect corresponding to the volume of the noble metal tip 93. When the length of the portion of the noble metal tip 93 embedded in the ground electrode 73 is 0.15 mm or less, the effect of improving the wear resistance by the noble metal tip 93 can be obtained while the separation resistance between the noble metal tip 93 and the ground electrode 73 is improved.

The noble metal tip 9 shown in FIG. 2(*a*) is joined to the surface of the ground electrode 7 without embedded in the ground electrode 7; i.e., the noble metal tip 9 is placed on and joined to the flat surface of the ground electrode 7. A portion embedded in the ground electrode 7 does not much contribute to the improvement in wear resistance. In the above case, no portion is embedded in the ground electrode 7. Therefore, the wear resistance improving effect corresponding to the volume of the joined noble metal tip 9 is obtained. In the noble metal tip 9 shown in FIG. 2(*a*), when the noble metal tip 9 is laser-welded to the ground electrode 7, a prescribed area of the second fused portion 36 is exposed at the side circumferential surface of the noble metal tip 9, and the wear resistance is reduced to an extent equivalent to the exposed area. However, since the first fused portion 34 ensures sufficiently high separation resistance, the noble metal tip 9 can be joined with the exposed area reduced as much as possible, and the effect of improving the wear resistance can thereby be maximized.

The spark plug 1 is produced, for example, as follows. The noble metal tip is prepared by any of the following methods. In one method, noble metal materials are obtained by mixing at a desired composition ratio and melting. The noble metal materials are, for example, rolled into a plate, and the plate is punched into a prescribed tip shape. In another method, an alloy is rolled, forged, or drawn into a wire-shaped or rod-shaped material, and then the obtained material is cut in its lengthwise direction into a prescribed length. By using any of the above methods, a noble metal tip having a desired shape and a desired composition can be formed. No particular limitation is imposed on the shape of the noble metal tip, and any appropriate shape such as a cylindrical shape, a circular disk shape, a polygonal disk shape, a polygonal columnar shape, or a particle shape can be used.

Electrode base materials forming the outer layer 27 of the center electrode 4 and the ground electrode 7 can be produced as follows. An alloy having a desired composition is melted using, for example, a vacuum melting furnace to prepare a molten alloy, and the molten alloy is subjected to vacuum casting to prepare an ingot. Then the ingot is subjected to hot working, drawing, etc. to appropriately adjust shape and dimensions, whereby an electrode base material having a prescribed shape and prescribed dimensions is produced. The outer layer 27 is formed from a cup-shaped electrode base material made of, for example, a Ni alloy. An inner member made of, for example, a Cu alloy having higher thermal conductivity than the electrode base material is prepared and inserted into the cup-shaped electrode base material. Then the resultant electrode base material is subjected to plastic working such as extrusion, whereby the center electrode 4 with the core 28 disposed inside the outer layer 27 is formed. The ground electrode 7 of the spark plug 1 in the present embodiment is formed from one type of material. However, the ground electrode 7 may include an outer layer and a core embedded at the center of the outer layer, as does the center electrode 4. In this case, as in the case of the center electrode 4, an inner member is inserted into a cup-shaped electrode base material, and the resultant electrode base material is subjected to plastic working such as extrusion. The product formed into a substantially prism shape by plastic working can be used as the ground electrode 7.

Next, one end portion of the ground electrode 7 is joined, by resistance welding or laser welding, to an end surface of the metallic shell 6 formed into a prescribed shape by, for example, plastic working. Then the metallic shell 6 with the ground electrode 7 joined thereto is subjected to Zn or Ni plating. Trivalent chromate treatment may be performed after the Zn or Ni plating.

Next, the noble metal tip 9 produced as described above is joined to the ground electrode 7 by laser welding. First, the noble metal tip 9 is placed on a desired position on the first electrode surface 31, and a laser beam is directed obliquely onto the vicinity of the line of intersection M on which the noble metal tip 9 intersects with the first electrode surface 31 to thereby form a fused portion $A_n$. This procedure is repeated a plurality of times over the entire line of intersection M, whereby the second fused portion 36 is formed as shown in FIG. 2(*b*). Next, a laser beam is directed onto the second electrode surface 33 along the center axis X of the noble metal tip 9, whereby the first fused portion 34 is formed so as to pass through the ground electrode 7 and bite, i.e., penetrate, into part of the noble metal tip 9 from a side opposite the gap forming surface 32 of the noble metal tip 9.

No particular limitation is imposed on the type, power, irradiation direction, number of times of irradiation, spot diameter, etc. of the laser beam used to form the second fused portion 36 and the first fused portion 34. When the second fused portion 36 is formed, it is preferable that the power, etc., of the laser beam are set such that the second fused portion 36 is formed on at least part of the line of intersection M. Specifically, it is preferable to form the second fused portion 36 such that the exposed area of the second fused portion 36 exposed at the side circumferential surface 35 of the noble metal tip 9 is reduced as much as possible within a range within which sufficiently high separation resistance is ensured. When the first fused portion 34 is formed, the power, etc., of the laser beam are set such that the first fused portion 34 is formed with the fused portion 8 exposed at the second electrode surface 33 and biting into at least part of the noble metal tip 9. In the spark plug 1 in the present embodiment, the first fused portion 34 is formed so as to be exposed at the second electrode surface 33. However, the first fused portion may be formed by directing a laser beam onto the gap forming surface 32 so that the fused portion is exposed at the gap forming surface 32. In the method of producing the spark plug 1 in the present embodiment, the second fused portion 36 is first formed, and then the first fused portion 34 is formed. However, no particular limitation is imposed on the order of formation of these fused portions, and the second fused portion 36 may be formed after the first fused portion 34 is formed.

Ceramic, for example, is fired into a prescribed shape to produce the insulator 3, and the center electrode 4 is inserted into the axial bore 2 of the insulator 3. Then glass powder forming the seals 10 and 11, a resistor composition forming the resistor 12, and the above glass powder are charged in this order into the axial bore 2 while preliminary compression is performed. Next, while the metal terminal 5 is inserted into the axial bore 2 from an end portion thereof, the resister composition and the glass power are compressed and heated. The resistor composition and the glass powder are thereby sintered, and the resistor 12 and the seals 10 and 11 are formed. Next, the insulator 3 with the center electrode 4 etc. fixed thereto is attached to the metallic shell 6 with the ground electrode 7 joined thereto. Finally, a distal end portion of the ground electrode 7 is bent toward the center electrode 4 such that one end of the ground electrode 7 faces the forward end portion of the center electrode 4, whereby the spark plug 1 is produced.

The spark plug according to the present invention is used as an ignition plug for an automobile internal combustion engine such as a gasoline engine. The spark plug is fixed to a prescribed position with the threaded portion screwed into a threaded hole provided in a head (not shown) that forms a sectioned combustion chamber of the internal combustion engine. The spark plug according to the present invention can be used for any type of internal combustion engine. The use of the noble metal tip having a sufficiently high wear resistance and a sufficiently high separation resistance allows provision of a spark plug which is high in durability. Therefore, the spark plug can be preferably used for a recent internal combustion engine in which the degree of compression within combustion chambers is high and/or lean fuel is used.

The spark plug according to the present invention is not limited to the above-described embodiments, and various modifications are possible so long as the object of the present invention can be achieved. For example, in the spark plug 1, the noble metal tip 9 is provided only on the ground electrode 7, and no noble metal tip is provided on the center electrode 4. However, noble metal tips may be provided on both the ground electrode 7 and the center electrode 4.

In the spark plug 1 described above, the noble metal tip 9 is placed on the first electrode surface 31, which is a side surface of the ground electrode 7. The noble metal tip 9 and the center electrode 4 are disposed such that the noble metal tip 9 and the forward end surface 30 of the center electrode 4 face each other in the direction of the axis O through the gap G. However, in the present invention, a noble metal tip may be provided on the forward end surface 30, and another noble metal tip may be provided on the distal end portion of the ground electrode so as to face a side surface of the noble metal tip provided on the forward end surface 30. In this case, the end surface of the noble metal tip provided on the ground electrode faces the side surface of the noble metal tip provided on the forward end surface 30 in the radial direction of the center electrode with a gap formed therebetween. In this case, one ground electrode having a noble metal tip facing the side surface of the noble metal tip disposed on the center electrode may be provided, or a plurality of such ground electrodes may be provided.

EXAMPLES

1. Separation Resistance Test (Production of Test Ground Electrodes)

Evaluation was performed using a cylindrical platinum-rhodium alloy tip having a diameter of 1.0 mm and a height of 1.0 mm as a noble metal tip and a prism-shaped INC601 base of 1.5 mm×2.8 mm as an electrode base. In examples shown below, the cylindrical noble metal tip and the prism-shaped electrode base material having a quadrilateral cross section were used. However, effects similar to those obtained when the noble metal tip had a cylindrical shape were obtained also when the noble metal tip used had a disk-like shape, a polygonal prism shape, a polygonal plate shape, or a combination of these shapes. In addition, effects similar to those obtained when the prism-shaped electrode base material was used were obtained also when a rod-like electrode base material having, for example, a circular, elliptical, or polygonal cross-sectional shape different from that of the prism-shaped electrode base material was used.

The noble metal tip was joined to the circumferential side surface of a distal end portion of the ground electrode by laser welding in the following manner. First, the noble metal tip was placed on the first electrode surface; i.e., the circumferential side surface of the distal end portion of the ground electrode. Then the vicinity of the line of intersection M on which the noble metal tip and the first electrode surface intersected with each other was irradiated with a laser beam a plurality of times in a direction obliquely to the first electrode surface. This operation was repeated a plurality of times over the entire line of intersection M. The noble metal tip and the ground electrode were fused by the irradiation with the laser beam to thereby form a second fused portion, and at least part of the second fused portion was exposed at the side circumferential surface of the noble metal tip. Next, the second electrode surface; i.e., the surface of the ground electrode opposite the surface on which the noble metal tip was placed, was irradiated once with a laser beam along the center axis of the noble metal tip. The power, irradiation time, etc. of the laser beam were controlled such that the laser beam pierced the ground electrode and reached at least part of the noble metal tip. The noble metal tip and the ground electrode were fused by the irradiation with the laser beam to thereby form a first fused portion. The first fused portion was exposed at the second electrode surface. By applying the laser beam in the manner described above, the first fused portion and the second fused portion were formed, and the noble metal tip was joined to the ground electrode, as exemplified in, for example, FIG. 2(*a*).

Test ground electrodes having different ratios of the fused portion shown in TABLE 1 were produced by appropriately changing the irradiation conditions such as the laser power, the spot diameter of the laser beam, and the number of times of irradiation with the laser beam when the noble metal tip was joined to the ground electrode. The area ratio of the fused portion was determined as follows. First, the noble metal tip was cut along a plane including the first electrode surface of the ground electrode. In the obtained cross section, a virtual circle having a diameter of 1.0 mm corresponding to the diameter of the noble metal tip was drawn with the origin at a point on the center axis of the noble metal tip. Then the total area of the first fused portion and the second fused portion; i.e., the area of the fused portion, included in the region surrounded by the circumference of the virtual circle was measured. Next, the ratio of the area of the fused portion with respect to the area, 0.785 $mm^2$, of the noble metal tip having a diameter of 1.0 mm was computed, and the computed ratio was used as the area ratio of the fused portion.

(Thermal Cycle Test)

For each of the above-produced test ground electrodes, the portion to which the noble metal tip was joined was heated using a gas burner, held at 1,000° C. for 120 seconds, and then allowed to cool for 60 seconds in a room temperature environment. The above procedure was defined as one thermal cycle, and the thermal cycle was repeated 1,000 times. This thermal cycle test is a desk test corresponding to a running of 100,000 km on the market.

(Evaluation of Separation Resistance)

Each test ground electrode after the thermal cycle test was cut along a plane including the axis of the noble metal tip. For example, when, in the obtained cross section, a gap was observed in the joint portion between the noble metal tip and the ground electrode, the noble metal tip was considered to be partially separated from the ground electrode. Then the length of the line segment in the separated portion was measured as a separation length. The ratio of the separation length to the length of the joined portion was computed as a separation ratio. When the separation ratio was 90% or less, the test ground electrode was evaluated as "A." When the separation ratio was higher than 90%, the test ground electrode was evaluated as "B." The results are shown in TABLE 1.

TABLE 1

| TEST NUMBER | AREA RATIO OF FUSED PORTION (%) | EVALUATION RESULTS |
|---|---|---|
| 1 | 52 | B |
| 2 | 55 | B |
| 3 | 58 | B |
| 4 | 60 | A |
| 5 | 64 | A |
| 6 | 68 | A |
| 7 | 72 | A |
| 8 | 75 | A |
| 9 | 78 | A |

As can be seen from TABLE 1, when the area ratio of the fused portion is 60% or higher, the separation resistance of the noble metal tip is improved.

2. Wear Resistance Test

Production of Test Spark Plugs

The noble metal tip was joined to the ground electrode in the same manner as in the separation resistance test except that the noble metal tip used was a cylindrical noble metal tip having a diameter of 1.0 mm and a height of 0.8 mm. Specifically, ground electrodes different in the axial length (embedded amount) of the portion of the noble metal tip embedded in the ground electrode as shown in TABLE 2 were produced.

Test spark plugs were produced using the produced ground electrodes and center electrodes formed from Inconel 600 in the manner described above.

In each of the test spark plugs, the distance (the gap G) between the gap forming surface of the noble metal tip joined to the ground electrode and the forward end surface of the center electrode was 0.90 mm. For each of the ground electrodes, the minimum distance between the gap forming surface of the noble metal tip and a point in the second fused portion that was closest to the gap G was measured. The measured value is shown as a "straight length" in TABLE 2.

(Durability Test)

Each of the produced test spark plugs was attached to an engine, and a durability test was performed in which the engine was operated for 200 hours under WOT (Wide-Open Throttle) conditions (rotational speed: 6500 rpm).

(Evaluation of Wear Resistance)

The gap G after the durability test was measured, and the increase in the gap length (the difference between the gap length measured before the durability test and that measured after the durability test) was computed. The results are shown in TABLE 2.

TABLE 2

| TEST NUMBER | EMBEDDED AMOUNT (mm) | STRAIGHT LENGTH (mm) | INCREASE IN GAP LENGTH (mm) |
|---|---|---|---|
| 11 | 0 | 0.4 | 0.05 |
| 12 | 0.1 | 0.3 | 0.07 |
| 13 | 0.15 | 0.25 | 0.08 |
| 14 | 0.2 | 0.2 | 0.17 |

As shown in TABLE 2, the smaller the amount of the noble metal tip embedded in the ground electrode, the smaller the increase in the gap length. When the embedded amount was 0.15 mm or less, the increase in the gap length could be reduced to 0.08 mm or less.

DESCRIPTION OF REFERENCE NUMERALS

1, 101: spark plug
2: axial bore
3: insulator
4: center electrode
5: metal terminal
6: metallic shell
7, 71: ground electrode
8, 81: fused portion
9: noble metal tip
10, 11: seal body
12: resistor
13: flange portion
14: rear trunk portion
15: forward trunk portion
16: leg portion
17: threaded portion
18: gas seal portion
19: gasket
20: tool engagement portion
21: crimp portion
22, 23: packing
24: talc
25: exposed portion
26: columnar portion
27: outer layer
28: core
30: forward end surface
31, 311, 312: first electrode surface
32, 323: gap forming surface
33, 333: second electrode surface
34, 341, 342, 343: first fused portion
35: side circumferential surface
36, 361, 362: second fused portion
37: first facing surface
38: second facing surface
G: gap
M, M1, M2: line of intersection
X, X1, X2: center axis of the noble metal tip Having described the invention, the following is claimed:

1. A spark plug, comprising:

a center electrode;

a ground electrode, comprising:

a first electrode area having a first electrode surface facing toward the center electrode, the first electrode surface having a recessed portion;

a second electrode area having a second electrode surface facing away from the center electrode; and a body defining an area between the first electrode area and the second electrode area that separates the recessed portion of the first electrode surface from the second electrode area;

a noble metal tip that is laser-welded to the ground electrode, the noble metal tip having a gap forming surface that forms a gap between the gap forming surface and the center electrode, the noble metal tip being partially embedded in and joined to the recessed portion of the first electrode surface, and a weld section joining the noble metal tip to the ground electrode through laser welding, the weld section comprising:

a first fused portion exposed on said second electrode surface and extending from the second electrode surface through the body and the recessed portion of the first electrode surface and into the noble metal tip; and a second fused portion exposed at a side circumferential surface of the noble metal tip.

2. A spark plug according to claim 1, wherein the noble metal tip and the ground electrode have respective facing surfaces facing the recessed portion of the first electrode surface.

3. A spark plug according to claim 2, wherein the ratio of the area of the weld section in a second region to the area of a first region is at least 60%, the first region being a region that is surrounded by the side circumferential surface of the noble metal tip and located in a virtual plane extending in a radial direction of the noble metal tip and including a point of the second fused portion that is closest to the gap, the second region being a projection of the first region onto the first electrode surface.

4. A spark plug according to claim 3, wherein a surface of the noble metal tip that is opposite the gap forming surface is joined entirely through the weld section to the ground electrode.

5. A spark plug according to claim 1, wherein an axial length of a portion of the noble metal tip embedded in the recessed portion of the first electrode surface is 0.15 mm or less.

6. A spark plug according to claim 1, wherein the first fused portion and the second fused portion are separated from each other.

7. A spark plug according to claim 1, wherein:

a bottommost surface of the noble metal tip is placed on and joined to the recessed portion of the first electrode surface.

8. A spark plug according to claim 7, wherein the first fused portion extends through said bottommost surface of said noble metal tip on a center axis of the noble metal tip.

9. A spark plug according to claim 1, wherein the recessed portion of the first electrode surface is defined by a bottom wall and a side wall, the bottom wall being separated from the second electrode area by the body, the side wall extending from the bottom wall and out of the recessed portion of the first electrode surface.

10. A spark plug according to claim 9, wherein the noble metal tip is joined to at least one of the walls defining the recessed portion of the first electrode surface.

11. A spark plug according to claim 10, wherein the first fused portion extends through the bottom wall of the recessed portion of the first electrode surface.

12. A spark plug according to claim 9, wherein the noble metal tip has respective facing surfaces facing the side wall and the bottom wall.

13. A spark plug according to claim 7, wherein the recessed portion of the first electrode surface is defined by a bottom wall and a side wall, the bottom wall being separated from the second electrode area by the body, the side wall extending from the bottom wall and out of the recessed portion of the first electrode surface, and wherein the bottommost surface is placed on and joined to the bottom wall.

* * * * *